US008968161B2

(12) United States Patent
Shapiro et al.

(10) Patent No.: US 8,968,161 B2
(45) Date of Patent: Mar. 3, 2015

(54) BALANCE PERTURBATION SYSTEM AND TRAINER

(75) Inventors: Amir Shapiro, Meitar (IL); Itshak Melzer, Lahavim (IL); Allan C. Entis, Tel Aviv (IL)

(73) Assignee: Ben Gurion University of the Negev Research and Development Authority, Beer Sheva (IL)

( * ) Notice: Subject to any disclaimer, the term of this patent is extended or adjusted under 35 U.S.C. 154(b) by 399 days.

(21) Appl. No.: 13/322,157

(22) PCT Filed: May 11, 2010

(86) PCT No.: PCT/IB2010/052079

§ 371 (c)(1),
(2), (4) Date: Nov. 23, 2011

(87) PCT Pub. No.: WO2010/136924

PCT Pub. Date: Dec. 2, 2010

(65) Prior Publication Data

US 2012/0071300 A1 Mar. 22, 2012

Related U.S. Application Data

(60) Provisional application No. 61/213,307, filed on May 28, 2009.

(51) Int. Cl.
*A63B 24/00* (2006.01)
*A63B 22/02* (2006.01)
(Continued)

(52) U.S. Cl.
CPC ..... *A63B 26/003* (2013.01); *A63B 22/0242* (2013.01); *F41A 33/00* (2013.01); *F41J 11/00* (2013.01); *A61H 3/008* (2013.01);
(Continued)

(58) Field of Classification Search
USPC ..... 482/51, 54; 119/700; 434/255, 258, 434/130, 302; 472/59, 136; 600/587, 595; 73/865.4, 172; 474/101, 148; 601/5, 601/23–24, 33–35, 84, 89–90, 97–98, 601/100–101, 104; 128/845
See application file for complete search history.

(56) References Cited

U.S. PATENT DOCUMENTS 5,089,960 A * 2/1992 Sweeney, Jr. ..... 463/6
5,913,684 A 6/1999 Latham et al.
(Continued)

FOREIGN PATENT DOCUMENTS

JP 11258973 9/1999

OTHER PUBLICATIONS

Oddsson et al; How to improve gait and balance function in elderly individuals—compliance with principles of training; European Review of Aging and Physical Activity; vol. 4, No. 1, pp. 15-23; published Feb. 15, 2007.
(Continued)

*Primary Examiner* — Loan H Thanh
*Assistant Examiner* — Jennifer M Deichl
(74) *Attorney, Agent, or Firm* — A.C. Entis-IP Ltd.

(57) ABSTRACT

Apparatus for exercising a person's balance control, the apparatus comprising: a motion stage operable to displace an object mounted thereto; a treadmill mounted to the stage and comprising a belt having a runway surface on which a person using the treadmill stands, walks and/or runs; and a controller that controls the motion stage to provide a displacement of the treadmill and thereby the treadmill runway surface.

19 Claims, 5 Drawing Sheets

(51) Int. Cl.

| | |
|---|---|
| ***A63B 26/00*** | (2006.01) |
| ***F41A 33/00*** | (2006.01) |
| ***F41J 11/00*** | (2009.01) |
| *A61H 3/00* | (2006.01) |
| *A63B 69/00* | (2006.01) |
| *A63B 71/06* | (2006.01) |

(52) U.S. Cl.

CPC ..... *A63B 69/0064* (2013.01); *A63B 71/0622* (2013.01); *A63B 2022/0271* (2013.01); *A63B 2024/0096* (2013.01); *A63B 2071/0666* (2013.01); *A63B 2220/40* (2013.01); *A63B 2220/52* (2013.01); *A63B 2220/70* (2013.01); *A63B 2220/836* (2013.01); *A63B 2230/62* (2013.01)

USPC ..... 482/54; 482/4

(56) References Cited

U.S. PATENT DOCUMENTS

| | | | | |
|---|---|---|---|---|
| 5,980,256 | A | 11/1999 | Carmein | |
| 6,152,854 | A | 11/2000 | Carmein | |
| 7,166,064 | B2 * | 1/2007 | Watterson et al. | 482/54 |
| 7,980,856 | B2 * | 7/2011 | Grabiner et al. | 434/258 |
| 2006/0052728 | A1 * | 3/2006 | Kerrigan et al. | 600/595 |

OTHER PUBLICATIONS

Oddsson et al.; Recovery from perturbations during paced walking; Gait and Posture 19 (2004), 24-34.

International Search Report; PCT/IB2010/052079 dated Aug. 18, 2010.

* cited by examiner

BALANCE PERTURBATION SYSTEM AND TRAINER

CROSS REFERENCES TO RELATED APPLICATIONS

The present application is a US National Phase of PCT Application No. PCT/IB2010/052079, filed on 11 May 2010, which claims the benefit under 35 U.S.C. §119(e) of U.S. Provisional 61/213,307 filed on 28 May 2009, the disclosure of which is incorporated herein by reference.

TECHNICAL FIELD

Embodiments of the invention relate to apparatus for measuring and training a person's balance control.

BACKGROUND

A person's ability to maintain body position and attitude, whether engaged in a relatively stationary activity such as standing or in a dynamic activity such as walking or running, is dependent on the person's balance control. Balance control is often considered to distinguish two different types of balance control: anticipatory balance control; and compensatory balance control.

Anticipatory balance control provides anticipatory postural adjustments (APAs) of attitude and position of body parts that are undertaken by a person in response to activities involving anticipated postural challenges. For example, walking up a step, which entails balancing the body on one foot in order to step up, is an activity that involves an anticipated postural challenge that elicits anticipatory balance control. Stepping onto a moving walkway in an airport, which entails preparing to maintain stable upright posture during a relatively fast transition from a stationary to a moving walking surface, is (usually) an anticipated postural challenge that elicits anticipatory balance control.

Though people do not normally think of anticipatory postural adjustments as voluntary, they are considered to be voluntary activities of the nervous-muscular system because they involve decisions, volitional decisions, which are made by the brain. Anticipatory postural adjustments are usually performed in periods of time between about 150 to 200 milliseconds (ms).

Compensatory balance control provides compensatory postural adjustments of attitude and position of body parts in response to, and to recover from, unanticipated postural challenges. For example, slipping on a wet spot on a marble floor, or catching ones foot on a curbstone, are typically unanticipated postural challenges that elicit compensatory balance control to provide compensatory postural adjustments in order to prevent falling. A sudden braking or lurching of a subway car is an unanticipated postural challenge to a person standing in the subway car that elicits the person's compensatory balance control to provide compensatory postural adjustments to prevent falling.

Compensatory postural adjustments (CPAs) are considered involuntary, reflex postural adjustments, because, while orchestrating complicated muscle synergies, they are not under volitional control and do not directly involve decisions by the brain. Compensatory postural adjustments are typically faster than APAs and are usually performed in periods of time less than about 100 ms.

Anticipated balance control, and/or compensatory balance control, often degrades with age and/or injury to the nervous and/or muscular system. In the elderly, degradation of balance control results in a relatively high rate of serious and fatal injuries. In the United States and in Israel, on the average one out of every three elderly people over the age of 75 years old and 50% of those who are 80 years old and over falls every In 2000, the total direct cost of all fall injuries for people 65 and older exceeded $19 billion. The financial toll for older adult falls is expected to increase as the population ages, and may reach $54.9 billion by 2020 (adjusted to 2007 dollars). In a study of people age 72 and older, the average health care cost of a fall injury totaled $19,440, which included hospital, nursing home, emergency room, and home health care, but not doctors' services.

SUMMARY

An embodiment of the invention relates to providing a Balance Measure and Perturbation ("BAMPER") system that provides a person with controlled challenges to the person's posture for measuring and training the person's balance control. The BAMPER system comprises a treadmill having a surface, hereinafter also referred to as a "runway" or "runway surface", on which the person stands, walks, or runs, which is controllable to produce measured displacements of the runway that challenge the person's posture and elicit the person's posture control to prevent his or her "losing balance" and possibly falling. In an embodiment of the invention, the BAMPER system comprises a safety harness to which the person is attached that is configured to protect the person from injurious falls as a result of unsuccessful mediation of postural challenges that confront the user during use of the BAMPER system.

Runway displacements, hereinafter also referred to as "challenge displacements", with which a BAMPER system challenges a user's posture are optionally two dimensional displacements that require a two dimensional coordinate system for their description. In some embodiments of the invention, challenge displacements are three dimensional displacements that require a three dimensional coordinate system for their definition. Challenge displacements may comprise anticipated challenge displacements and/or unanticipated challenge displacements, as discussed below.

Use of a BAMPER system in accordance with an embodiment of the invention, operates to train a user's balance control to cope with naturally occurring anticipated and/or unanticipated postural challenges. A BAMPER system is optionally configured for use in programmed training sessions in which a person is confronted with a preplanned program of challenge displacements to train and/or measure the person's balance control. In some embodiments of the invention, a BAMPER system is configured to be controlled by an operator who configurations challenge displacements in real time to confront a person on the BAMPER treadmill during the person's use of the BAMPER. In some embodiments of the invention, a BAMPER system, also referred to as a "BAMPER Gamer", is configured for use in a computer game, for operation in a self competitor mode or a multi-competitor mode.

There is therefore provided in accordance with an embodiment of the invention, apparatus for exercising a person's balance control, the apparatus comprising: a motion stage operable to displace an object mounted thereto; a treadmill mounted to the stage and comprising a belt having a runway surface on which a person using the treadmill stands, walks and/or runs; and a controller that controls the motion stage to provide a displacement of the treadmill and thereby the treadmill runway surface.

Optionally, the apparatus comprises an actuator controllable by the controller to cause a displacement of the runway surface characterized a localized displacement of a region of the runway surface in a direction substantially perpendicular to the runway surface. Additionally or alternatively, the controller is optionally programmable to control magnitude of the runway surface displacement.

In some embodiments of the invention, the controller is programmable to control direction of the runway surface displacement. In some embodiments of the invention, the controller is programmable to control acceleration of the runway surface that provides the runway surface displacement. In some embodiments of the invention, the controller is programmable to control deceleration of the runway surface that provides the runway surface displacement.

In some embodiments of the invention, the apparatus comprises at least one device controllable by the controller to generate a warning to the person that the treadmill runway surface is about to be displaced. Optionally, the controller controls duration of a time lapse between providing the alarm and the displacement of the treadmill In some embodiments of the invention, the apparatus comprises a harness that secures a person on the treadmill to prevent injurious falls. Optionally, the harness comprises a vest worn on the torso of the person. Additionally or alternatively, the harness optionally comprises leg straps that secure the harness to the person's legs.

In some embodiments of the invention, the apparatus comprises at least one strap or cable that anchors the harness overhead of the person to a support.

In some embodiments of the invention, the apparatus comprises apparatus configured to provide the person with a synthetic, virtual and/or augmented, reality. Optionally, the apparatus configured to provide a synthetic reality generates virtual obstacles in the synthetic reality that challenge the person's posture. Additionally or alternatively, the apparatus configured to provide a synthetic reality optionally generates sounds to disturb the person's balance control.

In some embodiments of the invention, the apparatus comprises at least one sensor that generates signals useable to determine a measure of proficiency of the person's balance control. Optionally, the at least one sensor comprises an accelerometer. Optionally, the accelerometer is attached to the person's body. In some embodiment of the invention, the at least one sensor comprises a strain gauge. In some embodiment of the invention, the at least one sensor comprises a motion capture system that provides images that track the person's motions while on the treadmill In some embodiment of the invention, the measure of proficiency comprises a scalar function. In some embodiment of the invention, the measure of proficiency comprises a tensor function. Optionally, the tensor function comprises a one dimensional tensor. Additionally or alternatively, the tensor function optionally comprises a two dimensional tensor.

There is therefore provided in accordance with an embodiment of the invention, apparatus for playing a game, the apparatus comprising: first and second apparatuses in accordance with an embodiment of the invention; a game controller operable by a person on the first apparatus that controls displacements of the treadmill runway of the second apparatus; and a game controller operable by a person on the second apparatus that controls displacements of the treadmill runway of the first apparatus.

BRIEF DESCRIPTION OF FIGURES

Non-limiting examples of embodiments of the invention are described below with reference to figures attached hereto that are listed following this paragraph. Identical structures, elements or parts that appear in more than one figure are generally labeled with a same numeral in all the figures in which they appear. Dimensions of components and features shown in the figures are chosen for convenience and clarity of presentation and are not necessarily shown to scale.

DETAILED DESCRIPTION

Figure 1A:
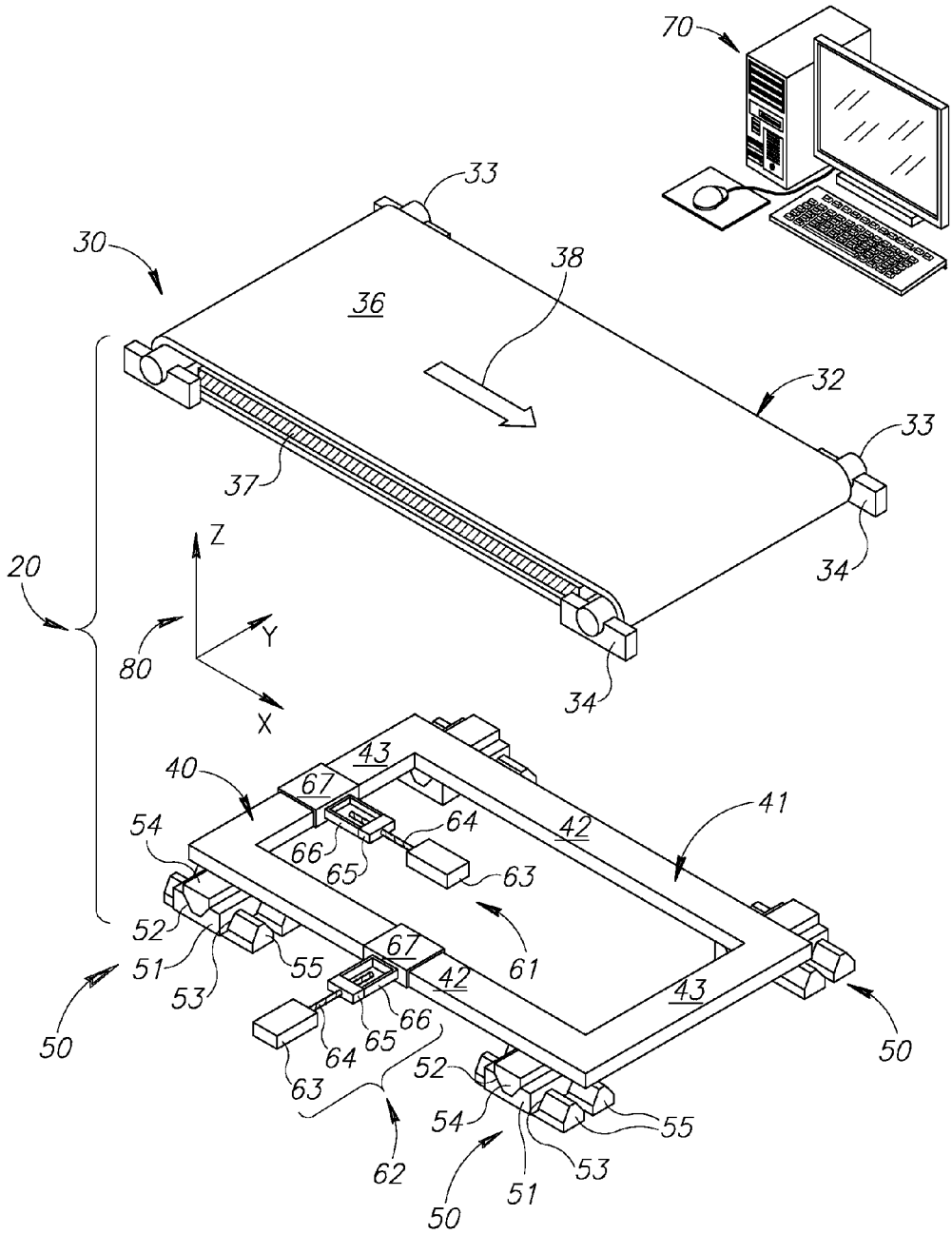
FIGS. 1A and 1B schematically show exploded and assembled views respectively of a BAMPER system, in accordance with an embodiment of the invention.

An embodiment of the invention provides a BAMPER system for measuring and training a person's balance control that comprises a treadmill having a runway surface on which a person stands, walks, or runs that is controllable to generate runway displacements, i.e. challenge displacements, which present the person with motions that challenge the person's posture. The challenge displacements elicit the person's posture control to prevent his or her "losing balance" and falling.

In an embodiment of the invention, the treadmill is mounted to a motion platform which is controllable to undergo measured displacements that in turn displace the treadmill and thereby the treadmill runway to provide challenge displacements. Use of the treadmill in accordance with an embodiment of the invention, operates to train a user's balance control to cope with naturally occurring anticipated and/or unanticipated postural challenges.

In an embodiment of the invention, a BAMPER system comprises a safety harness to which the person is attached that is configured to protect the user from injurious falls during use of the BAMPER system and experience of challenge displacements with which the BAMPER system confronts the user. Optionally, the harness comprises a parachute-like harness that is attached overhead of the person and operates to catch the person and prevent a fall in the event that the person's balance control response to challenge displacements are not successful in preventing a fall. Hereinafter, a "fall" by a person on a BAMPER system comprising a safety harness is defined as a situation in which the safety harness is brought into play to aid the person in maintaining his or her balance in responding to a challenge displacement.

According to an embodiment of the invention, a BAMPER system comprises a controller that controls direction and/or magnitude of a challenge displacement of the treadmill and/or a period during which the challenge displacement occurs. In an embodiment of the invention, the controller controls acceleration and/or deceleration of the treadmill runway that produce the challenge displacement of the treadmill.

In an embodiment of the invention, challenge displacements of the treadmill runway are two dimensional, substantially coplanar displacements. In an embodiment of the invention, challenge displacements are controllable to have a component along any axis of a three dimensional coordinate system.

According to an embodiment of the invention, relatively localized regions of the treadmill runway are controllable to undergo challenge displacements substantially perpendicular, "up" or "down", to the contact surface. Localized "up" or "down" challenge displacements of the treadmill runway in accordance with an embodiment of the invention, are used to mimic unexpected postural challenges to a person, such as by way of example, a stone or depression respectively, that a person may encounter and trip on while walking or running.

According to an embodiment of the invention, the controller controls challenge displacements so that a user is confronted with postural challenges responsive to the user's ability to cope with postural challenges. Optionally, the user's ability to cope with postural challenges is estimated by a measure of proficiency (MOP) that characterizes the person's balance control. In an embodiment of the invention, the controller controls features, such as direction, magnitude, or acceleration, of challenge displacements that challenge a person's posture responsive to the person's MOP. Optionally, the controller increases and/or varies postural challenges that the BAMPER system presents to a user, responsive to changes in the person's MOP. A MOP may comprise different values indicative of balance control proficiency for anticipated and unanticipated postural challenges.

In some embodiments of the invention, the MOP is a scalar quantity. Optionally, the MOP is a tensor of degree one or greater. For example, a person may exhibit better or worse balance control depending on a direction of a challenge displacement that challenges the person's posture. For such a situation, a MOP that is a vector quantity, i.e. a one dimensional tensor, may be advantageous for describing the person's MOP. If the person has different probabilities for falling in different directions responsive to a same direction of a challenge displacement, a second degree tensor, in accordance with an embodiment of the invention, may be advantageous to describe the person's balance control proficiency.

A BAMPER system optionally comprises at least one sensor configured to provide signals that are processed by the controller to generate the MOP for the person's balance control. Optionally, the at least one sensor, hereinafter also referred to as a "monitoring sensor", comprises at least one monitoring sensor responsive to distribution and changes therein, of a person's weight on the runway surface, of the treadmill Optionally, the at least one monitoring sensor comprises a sensor comprised in a motion platform that supports the runway surface. Optionally, the at least one sensor comprises a sensor comprised in the harness. In some embodiments of the invention, the at least one monitoring sensor comprises a sensor that is located on the person's body. The at least one monitoring sensor may comprise a stress sensor, a strain sensor and/or an accelerometer. An at least one monitoring sensor located on the person's body may comprise a sensor, such as an electrical impedance myography (EIM) sensor, for monitoring the person's muscle activity in response to challenge displacements.

In an embodiment of the invention, the controller controls the treadmill so that treadmill challenge displacements are unexpected by a person walking or running on the treadmill The unexpected challenge displacements provide unanticipated postural challenges to the person that elicit and train the person's compensatory balance control. It is expected that training on the BAMPER system will aid in improving the person's ability to prevent falling when challenged by naturally occurring unanticipated postural challenges.

In an embodiment of the invention, the controller generates a warning signal that alerts a person on the treadmill that a challenge displacement that will challenge the person's posture is imminent. Optionally, duration of a time lapse, hereinafter a "warning time", between a time that the warning signal is given and the occurrence of the challenge displacement is controllable. Challenge displacements provided to the person that are preceded by a warning signal are considered to be anticipated postural challenges and are also referred to as "anticipated challenge displacements". Anticipated challenge displacements are expected to elicit and train the person's anticipatory balance control to prevent falling when challenged by naturally occurring anticipated postural challenges.

In an embodiment of the invention, operation of a BAMPER system, i.e. a "BAMPER gamer", is configured to challenge a person's posture in the framework of a self-competitor computer game session in which the person competes against the BAMPER system to maximize a score. Unanticipated and/or anticipated posture challenges are presented to the person while navigating a walking/running course on the BAMPER treadmill, with the person having an objective of achieving as large as possible a game score by successfully coping with the challenges. Besides coping with challenge displacements and not falling during a game session, optionally the game requires that the person perform various tasks, such as successfully touching target regions in a computer video screen, during the game session.

In some embodiments of the invention, a BAMPER gamer is configured for use in a multi-competitor game mode. The BAMPER system comprises a "game controller", such as an interactive display system for inputting instructions to a computer, or a radio joystick controllable to transmit signals to a computer that enables a user of the BAMPER Gamer to control displacements of a treadmill runway of at least one other BAMPER Gamer. At least two opponent competitors, each on his or her own BAMPER Gamer, play against each other, in a game, optionally referred to as "Throw-M", each using the game controller to control challenge displacements on an opponent's BAMPER Gamer system to attempt to cause the opponent to lose balance. A scoring system determines which competitor is most successful in coping with posture challenges initiated by other competitors.

In some embodiments of the invention, a BAMPER Gamer comprises a device, such as a head mounted display (HMD) or virtual reality glasses, for immersing a user of the BAMPER Gamer in a virtual or augmented reality to enhance a game played by a user of the BAMPER Gamer. In some embodiments of the invention, visual and/or aural stimuli are generated in the environment provided by the HMD to challenge the user's posture or disturb the user's balance control. For example, the user might be required to exhibit anticipatory or compensatory postural adjustments to avoid anticipated and/or unanticipated virtual obstacles while walking or running on the treadmill Or sudden "virtual" sounds from different directions may be used to startle the user and possibly affect his or her balance control.

It is noted that whereas a virtual or augmented environment has been described for use in a BAMPER Gamer, virtual and augmented reality, and any features used in, or that characterize a BAMPER Gamer, may of course be used in non-game programs to monitor and train a person's balance control.

Figure 1B:
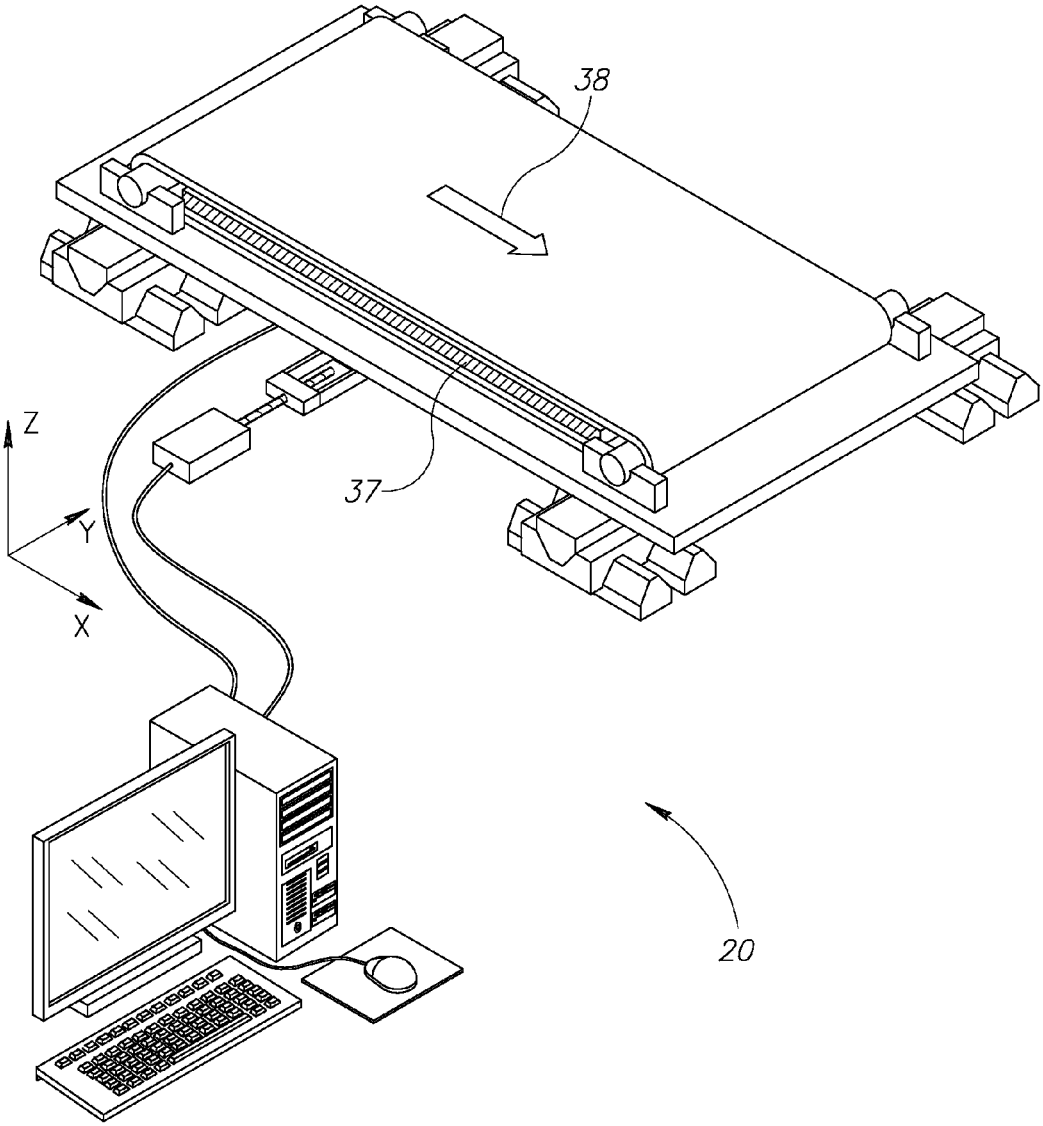

FIGS. 1A and 1B schematically show exploded and assembled views respectively of a BAMPER system 20 comprising a treadmill 30, a motion platform 40, and a controller 70 for controlling the treadmill and motion platform, in accordance with an embodiment of the invention.

Treadmill 30 optionally comprises a treadmill belt 32 mounted to two rollers 33 each of which rollers is supported by two roller mounts 34. Optionally, the roller mounts are bearing mounts that support the rollers so that they can turn freely. A portion 36, referred to as the treadmill runway 36, of treadmill belt 32 on which a person using BAMPER system 20 stands, walks, or runs, rests on a support plate 37 supported by support mounts 34. At least one of rollers 33 is coupled to a suitable motor (not shown) controllable to rotate the roller and cause runway 36 to move in a direction, optionally indicated by a block arrow 38, opposite to a direction in which a person walks or runs on the treadmill For convenience of presentation a coordinate system 80 having its xy plane parallel to the plane of runway 36 and its x-axis parallel to the direction indicated by block arrow 38 is used to reference locations and orientations of features of BAMPER 20.

Motion platform 40 optionally comprises a motion frame 41 having stiles 42 parallel to the x-axis of coordinate system 80 and rails 43 parallel to the y-axis of the coordinate system. The motion frame is mounted to four crossed slide bearings 50. Each crossed slide bearing 50 comprises a slide block 51 formed having a top groove 52 and two bottom grooves 53. A top slider seats in top groove 52 and slide block 51 is supported by bottom sliders 55 that seat in bottom grooves 53. Top groove 52 is parallel to the y-axis of coordinate system 80 and top slider 54 is free to move back and forth parallel to the y-axis in groove 52. Bottom grooves 53 are parallel to the x-axis of coordinate system 80 and slide block 51 is free to move back and forth parallel to the x-axis on bottom sliders 55. Motion frame 41 is optionally fixed to the top slider of each crossed slide bearing 50. Bottom sliders 55 of each crossed slide bearing 50 are optionally stationary, and typically fixed to a floor on which BAMPER 20 is supported. The mounting configuration of motion frame 41 to crossed slider bearings 50, enables the motion frame to be freely moveable along both the x-axis and the y-axis.

An x-motion drive 61 and a y-motion drive 62 control motion of motion frame 41, and thereby displacements of runway 36, along the x-axis and y-axis respectively. Each motion drive optionally comprises a motor 63 controllable to rotate a threaded drive rod 64 which is coupled to a ball screw 65. Ball screw 65 converts rotary motion of drive rod 64 to linear translation of a U-bracket 66 connected to a frame couple 67. Frame couple 67 of x-motion drive 61 is coupled to a rail 43 of motion frame 41 so that the rail is free to slide parallel to its length in the frame couple in either direction along the y-axis but is fixed to the frame couple along the x-axis. Frame couple 67 of y-motion drive 62 is coupled to a stile 42 of motion frame 41 so that the stile is free to slide along its length in the frame couple in either direction along the x-axis but is fixed to the frame couple along the y-axis.

The coupling configuration of x and y-motion drives 61 and 62 to motion frame 41, and the mounting configuration of the motion frame on crossed slide bearings 50, enables the x-motion drive to control displacement of the motion frame along the x-axis independent of operation of the y-motion drive and displacements of the motion frame along the y-axis. Similarly, the y-motion drive is enabled to control displacement of motion frame 41 along the y-axis independent of operation of the x-motion drive and displacements of the motion frame along the x-axis. As noted above, controlling displacements of motion frame 41 along the x and y-axes controls displacements of runway 36 along these axes. "Displacements" of runway 36 may of course also be controlled by controlling acceleration of runway belt 32.

In some embodiments of the invention, BAMPER system 20 is controllable to displace localized regions of runway 36 of treadmill 30 up and down in directions parallel to the z-axis. Optionally, a support plate 137, schematically shown in FIG. 1C, replaces support plate 37 that supports runway 36 shown in FIGS. 1A and 1B and generates local displacements of runway 36 along the z-axis. Support plate 137 optionally comprises a base plate 138 having mounted thereon an x-y array of, respectively, rows 143 and columns 144 of z-displacement actuators 145 and a runway plate 139 that is attached to the base plate having a top surface 140 on which runway 36 rests.

Figure 1C:
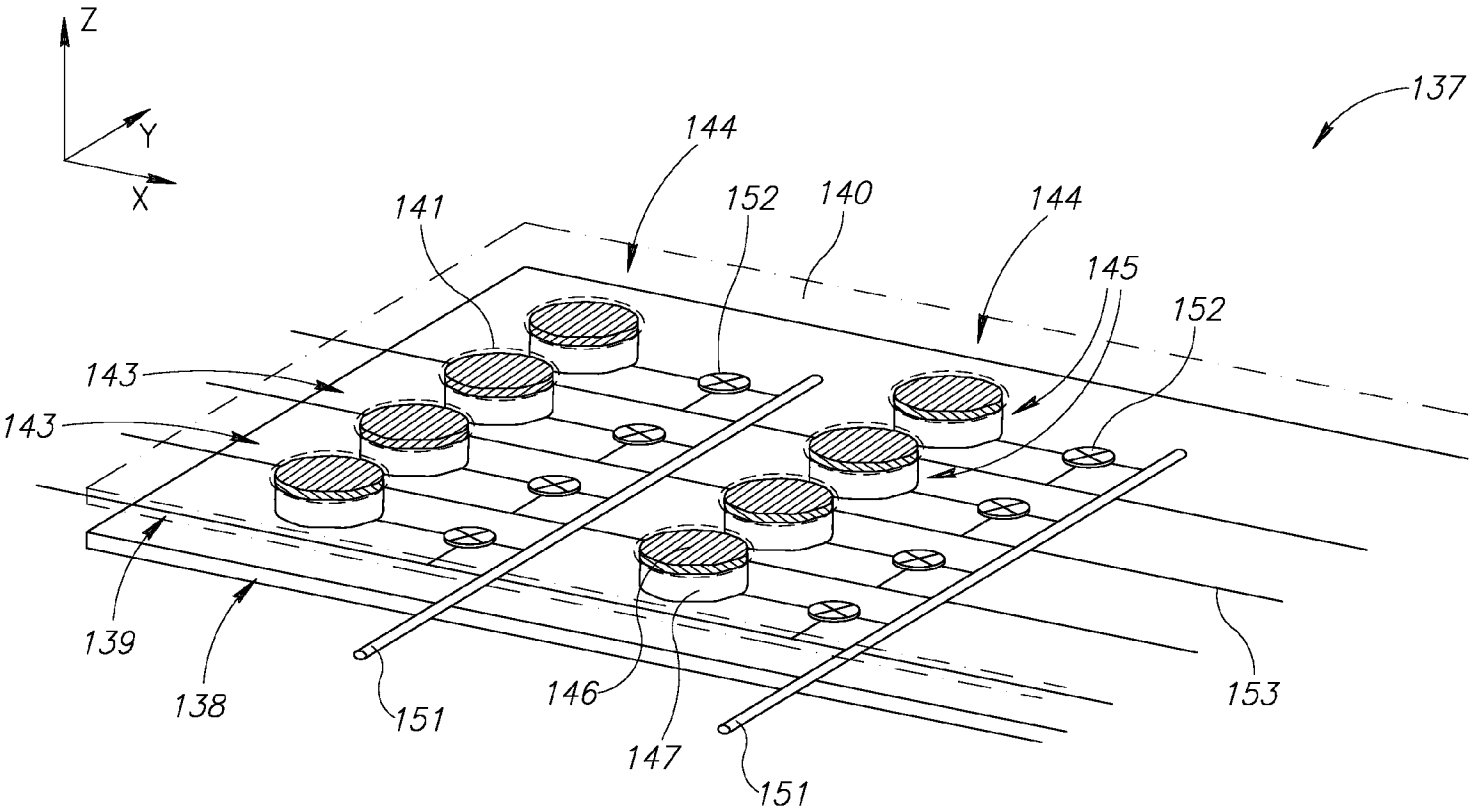
FIG. 1C schematically shows a support plate on which the runway of a BAMPER system rests that provides up and down challenge displacements of relatively localized regions of the runway, in accordance with an embodiment of the invention.

Runway plate 139 and its features are shown in dashed lines to indicate that features that would normally be hidden by the runway plate in the perspective of FIG. 1C are shown as if the runway plate is transparent. Each z-displacement actuator 145 comprises a low friction contact plate 146 and is controllable to move the contact plate up and down parallel to the z-axis to contact and move a localized region of runway 36 respectively up and down. Contact plate 146 is formed so that frictional forces between the plate and treadmill belt 32 is relatively small. Optionally, the friction plate is formed from a low friction material such as Teflon to provide low friction contact with the treadmill belt. Optionally, the friction plate comprises at least one bearing such as a roller bearing or ball bearing to provide low friction contact. Runway plate 139 is formed having clearance holes 141 for contact plates 146, which allow the contact plates to freely move up and down parallel to the z-axis through the clearance holes. When a z-displacement actuator 145 is not operated to displace a localized region of runway 36, its contact plate 146 is positioned flush with surface 140 of the runway plate. In FIG. 1C none of actuators 145 are activated. Optionally, contact plate 146 of an actuator 145 seats on a pneumatic or hydraulic expansion cell 147 that is inflated and deflated with a gas or liquid to move contact plate 146 up and down. Optionally, the cells are controlled by an array of pneumatic or hydraulic manifolds 151 parallel to the y axis (i.e. parallel to the columns of actuators 145), and rows of electrically controlled valves 152 parallel to the x axis. Each manifold 151 is optionally connected to all expansion cells 147 in a different column 144 of z-displacement actuators 145. Optionally, all valves 153 in a same row of valves are connected to a same control line 153 for transmitting electrical control signals to the valves. Increasing or decreasing pressure in a manifold 151 connected to a given expansion cell 147, and transmitting control signals along a signal line 153 to which valve 152 that connects the manifold to the expansion cell to open and close the valve raises or lowers the cell's contact plate 145 and the overlying region of runway 36. It is noted that whereas actuator 145 comprises a pneumatic act, practice of the invention is not limited to pneumatic actuators, and actuator 145 may comprise for example an electric linear actuator or a cam actuator.

In some embodiments of the invention, runway 36 can be tilted to change its pitch (rotation around the y-axis) or yaw (rotation about the x-axis). Optionally, each crossed slide bearing 50 is mounted to a hydraulic piston or electric linear actuator (not shown) to raise and lower the slide bearing and control pitch and yaw of the runway.

It is noted that whereas BAMPER 20 is shown comprising a single treadmill belt 32 a BAMPER system in accordance with an embodiment of the invention is not limited to a single treadmill belt. For example, A BAMPER system in accordance with an embodiment of the invention, may comprise a plurality of adjacent, individually controllable treadmill belts, each having its own runway. When using the BAMPER, different feet of a user may contact different runways, or a same foot may fall on a seam between runways so that the foot contacts two adjacent runways. The user may be confronted with postural challenges by operating the treadmill belts at different speeds or suddenly change a speed of a treadmill belt.

Figure 2:
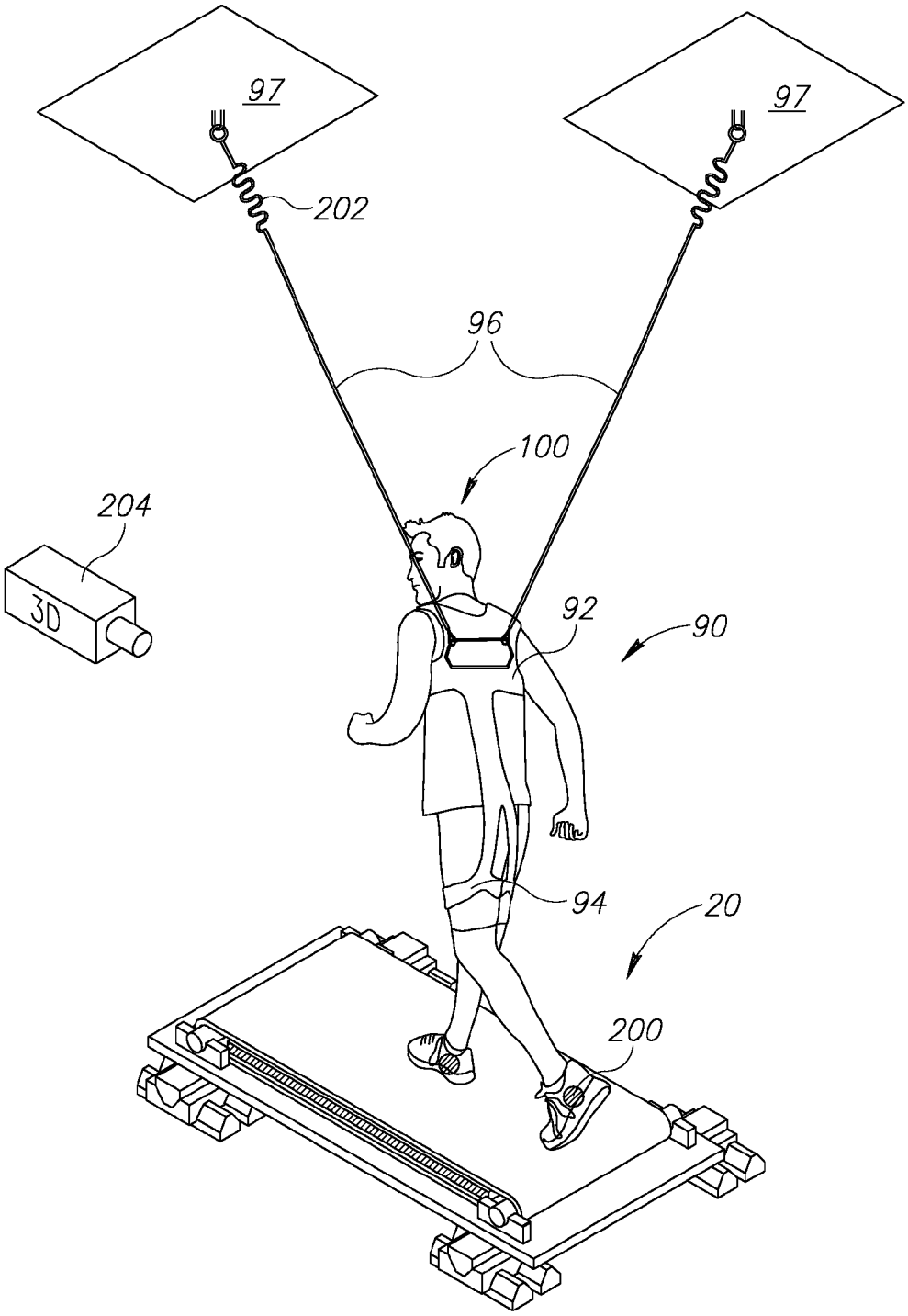
FIG. 2 schematically shows a BAMPER system in use, in accordance with an embodiment of the invention.

FIG. 2 schematically shows BAMPER system 20 shown in FIGS. 1A-1C being used to challenge and train the balance control of a person 100, hereinafter referred to also as a "trainee", on runway 36 of the BAMPER system, in accordance with an embodiment of the invention.

In an embodiment of the invention, BAMPER system 20 comprises a safety harness 90 to which the person on runway 36 is optionally attached to prevent the trainee from falling if he or she does not successfully cope with a challenge displacement presented by the BAMPER system. Optionally, harness 90 is similar to a parachute harness and is attached to the trainee with a torso vest 92 and leg straps 94 produced from flexible fabric such as a Spandex fabric. Ceiling cables or straps 96 that are attached to torso vest 92 anchor harness 90 overhead of the trainee, optionally to a support beam that is comprised in BAMPER 20, or as schematically shown in FIG. 2 to a ceiling 97.

An operator (not shown) operates BAMPER controller 20 to configure a training session for trainee 100 that confronts the trainee with challenge displacements that challenge the trainee's posture and exercises and trains his or her balance control. Optionally, the operator inputs values into the controller for a suite of training session parameters, hereinafter also referred to as "posture challenge parameters", which characterize the challenge displacements. The posture challenge parameters optionally comprise: treadmill speed, i.e. speed of motion of runway 36 in the direction of block arrow 38; directions, and magnitudes of challenge displacements; accelerations and decelerations of runway 36 that provide the challenge displacements; durations of challenge displacements; and/or frequency and/or order of occurrence of challenge displacements.

By way of a numerical example, it can be advantageous for training people older than about 65 years, or people who are not trained athletes, that challenge displacements in a training session have maximum magnitude equal to about 10 cm, and that accelerations and decelerations of treadmill runway surface 36, and/or localized regions thereof, that create the displacements have a maximum less than g, the acceleration of gravity (9.8 $m/s^2$). Optionally, for a given challenge displacement, deceleration of the treadmill surface or portion thereof is equal to about one half of the acceleration. It can be advantageous that challenge displacements occur with a frequency that is less than about 60/hr and that treadmill speed be limited to a maximum of about 6 km/hr.

An initial training session for trainee 100 is optionally a "calibration session", which is used to provide a base measure, i.e. a base MOP, for the trainee's balance control proficiency. By way of example, a calibration session may comprise challenging the trainee's posture with a sequence of challenge displacement cycles. In each cycle the trainee is optionally confronted with a challenge displacement (FIG. 1A) of runway 36 in each angular direction 0°, 45°, 90°, . . . , and 315°, relative to the x-axis (i.e. 0°, is in the plus x-direction) and the angular direction increases counterclockwise. Difficulty of the challenge displacements in a same challenge displacement cycle is the same, but from one cycle to a next, difficulty of challenge displacements increases.

For example, for challenge displacements in a cycle of the sequence immediately subsequent to any given cycle in the sequence, magnitude of the displacements in the subsequent cycle may be increased and/or their duration decreased relative to magnitude and/or duration in the given cycle. For each cycle in the calibration session, performance of the trainee in mediating the challenge displacements is monitored to determine proficiency and a MOP for the trainee's performance as a function of difficulty and direction of the displacements.

Optionally, the trainee's balance control performance for a challenge displacement in a given angular direction and a given level of difficulty is measured by a probability that the trainee falls when confronted with the challenge displacement. A MOP for the trainee performance is optionally determined to be a probability to fall at a given standard level of challenge displacement difficulty for each of the set of standard directions along which the trainee is challenged. For example, a standard set of angular directions for defining the MOP optionally comprises the eight angular directions, 0°, 45°, 90°, . . . , and 315°. If the MOP is defined by a probability of falling at the standard difficulty level averaged over the standard directions the MOP has the form of an eight dimensional vector. However, a trainee, when confronted with a displacement challenge in a given direction may have significantly different probabilities for falling in different directions. For such a situation the MOP may advantageously have a form of a square 8×8 a matrix, i.e. a two degree tensor.

For example, assume for a challenge displacement at 90°, i.e. displacement of runway 36 in the plus y-direction, at the standard level of difficulty the trainee exhibits a 10% probability of falling in the 270° direction (minus y-direction), a 5% probability of falling in the 225° direction and a 20% probability of falling in the 315° direction. Rather than average these probabilities to provide a single probability of falling for challenge displacements at 90°, it can be advantageous to use these values to define three values in a MOP matrix.

In some embodiments of the invention a MOP for the trainee is measured by how fast the trainee recovers from a challenge displacement, does not fall and manages to stabilize his or her posture. A "recovery time" may for example be time from which the trainee's foot leaves runway 36 as a result of a challenge displacement to a time at which the trainee's foot makes stable contact with the runway.

Determining whether the trainee loses his or her balance and falls or successfully deals with a challenge displacement during the calibration session is optionally determined responsive to signals generated by at least one monitoring sensor used to monitor the trainee during the session.

In some embodiments of the invention, the at least one monitoring sensor comprises an at least one accelerometer 200 attached to the trainees body. Optionally an accelerometer 200 is attached to each of the trainee's feet and signals generated by the accelerometers are used to determine direction and magnitude of aberrant accelerations of the feet indicative of loss of balance and failure to prevent a fall by a compensatory stepping response. Optionally, if a trainee fails to mediate a challenge displacement the challenge displacement and/or motion of the treadmill are stopped.

In some embodiments of the invention, the at least one sensor comprises a strain gauge 202 optionally coupled to each ceiling strap 96 that anchors harness 90 to ceiling 97. Signals from strain gauges 202 are optionally used to determine if the trainee's body weight is supported by the strap, and if so how much of the weight the strap supports. Differences in the signals from strain gauges 202 in the ceiling straps are optionally processed to determine a direction of a fall.

In some embodiments of the invention, support plate 37 OR 137 comprises a piezoelectric sensor (not shown) that generates signals responsive to the distribution and time dependence of the trainee's weight on runway 36. Optionally, the piezoelectric sensor comprises a piezoelectric polymer film bonded or adhered to the surface of the support plate and on which runway 36 rests. Pressure from the trainee's feet on the runway and thereby on the piezoelectric polymer film generate electrical signals that are sensed and processed to determine temporal and spatial profiles of the trainee's weight on runway 36 that are used to indicate how the trainee copes with challenge displacements.

BAMPER 20 optionally comprises a motion capture system that images the trainee and provides real time images of the trainee. The images are used to determine temporal and spatial profiles of anticipatory postural adjustments and/or compensatory postural responses that the trainee makes in response to challenge displacements. The profiles are used to determine how adept the trainee is at responding to challenge displacements, whether he or she falls, and in case of a fall, direction of the fall. The motion capture system may be any of various motion capture systems known on the art. In some embodiments, the motion system comprises fiducial marking, attached to the person's body and a camera for imaging the fiducial markings. Optionally, the motion capture system comprises any of various 3D imaging system, such as a triangulation system or a time of flight 3D imaging system, that provides three-dimensional images of the trainee in real time. By way of example, in FIG. 2, BAMPER 20 is shown comprising a 3D video camera 204, such as that described in U.S. Pat. Nos. 6,057,909 and 7,224,384, the disclosures of which are incorporated herein by reference.

The operator optionally programs BAMPER controller 70 to control BAMPER 20 to confront trainee 100 with unanticipated and/or anticipated challenge displacements and their frequency of occurrence during the calibration session. To provide anticipated challenge displacements, BAMPER system 20 optionally comprises a device operable to provide the trainee with a warning signal prior to confronting the trainee with a challenge displacement. Any of various methods and devices may be used to provide the displacement challenge warning. Optionally, the warning signal comprises an audible alarm generated by a speaker in the neighborhood of the trainee or by a set of earphones worn by the trainee. Optionally, the warning signal comprises a visual alarm provided by turning on a light or presenting an alarm image on a computer screen.

Following the calibration session, the operator creates a BAMPER balance control training and monitoring program for the trainee responsive to the MOP determined for the trainee during the calibration session. The training and monitoring program is used to program controller 70 to configure at least one training session for the trainee on BAMPER 20 that confronts the trainee with a sequence of challenge displacements and treadmill speeds designed to exercise and train the trainee's balance control. In an embodiment of the invention, the operator configures the posture challenge parameters for the training session so that challenge displacements challenge and train relatively weaker competencies of the trainee's balance control more frequently than stronger aspects.

For example, if the trainee's MOP shows that the trainee has a relatively high frequency of losing balance and falling for a given challenge displacement and treadmill speed, the training session confronts the trainee more frequently with challenge displacements and treadmill speeds configured to improve the trainee response to the given challenge displacement. Optionally, the challenge displacements that exercise the trainee's weakness are graduated so that their difficulty increases during a training session and/or from one training session to a subsequent training session.

Figure 3:
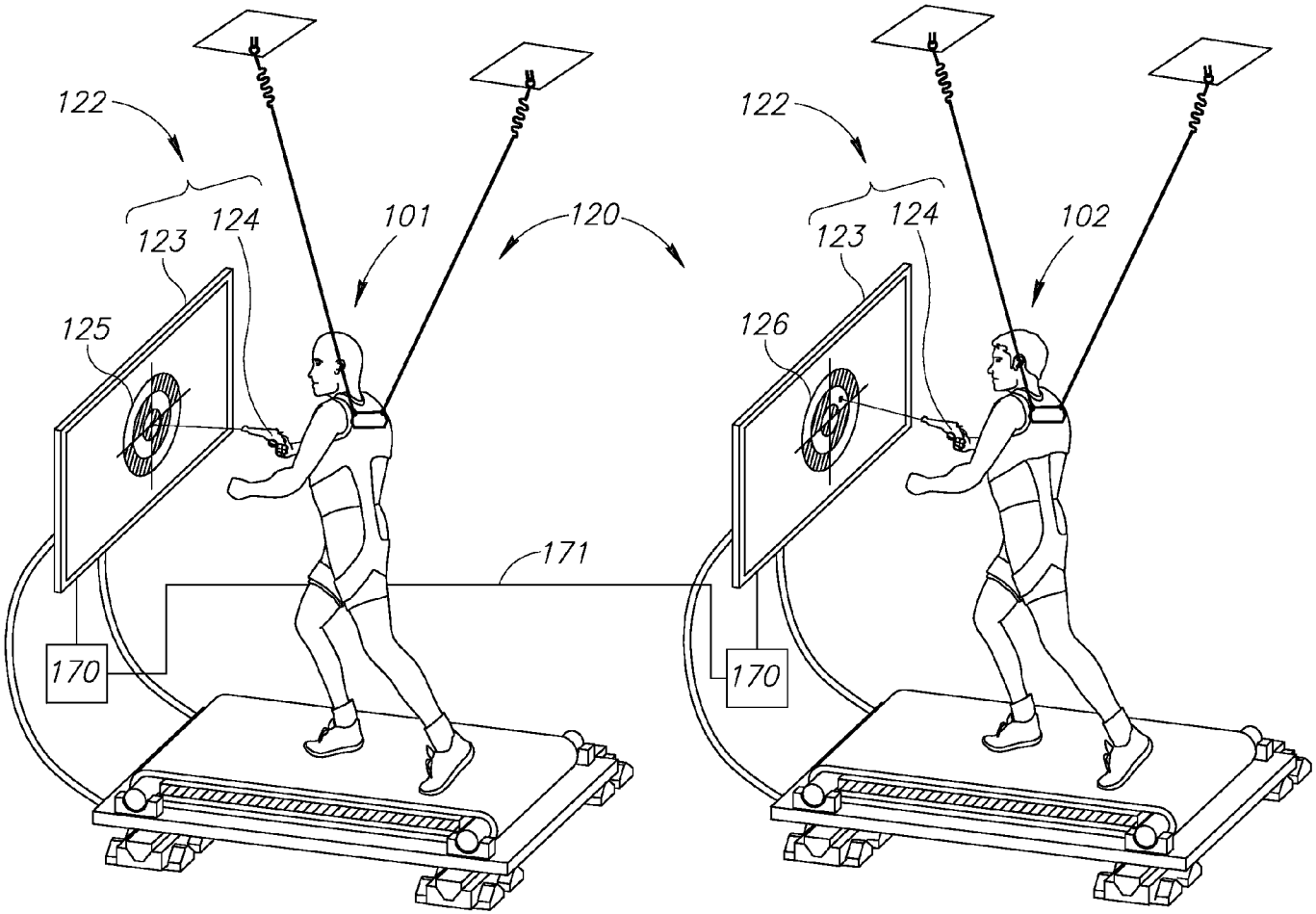
FIG. 3 schematically shows a pair of BAMPER gamers, being used to play a multi-competitor computer game in accordance with an embodiment of the invention.

In some embodiments of the invention, a BAMPER, hereinafter referred to as a "gaming BAMPER", is configured to be used by one or a plurality of people in a framework of a computer game. FIG. 3 schematically shows two people 101 and 102 using gaming BAMPERS 120 in accordance with an embodiment of the invention.

Each gaming BAMPER 120 optionally comprises features and components similar to BAMPER 20, but in addition comprises an interactive video display system 122. The interactive display system enables each player 101 and 102 to input instructions to the player's gaming BAMPER's controller 170 that control challenge displacements in the other player's gaming BAMPER. Optionally, controllers 170 of BAMPERS 120 are connected by a data cable 171 to facilitate transmission of instructions between the BAMPERS. Each player 101 and 102 attempts to complete a walking or running course on his or her own gaming BAMPER treadmill 30 as quickly as possible. While attempting to finish the course the player controls challenge displacements on the other player's BAMPER to cause the other player to lose balance and fall, and thereby disrupt and slow the other player's successful completion of the other player's course.

Optionally, the interactive display system comprises a video screen 123 that enables a player to point to and select a localized region of the screen to input instructions into the BAMPER controller 170 that control generating challenge displacements on the other player's BAMPER. Optionally, the screen is a touch screen and the user touches a region of the screen with a finger to select the region. In some embodiments of the invention, the interactive display system does not require that the user touch the screen and comprises a pointer, such as a laser pointer. Any of various technologies and devices known in the art for pointing to and selecting a region of a video screen without touching the screen, may be used in implementation of the invention. For example, region selection may be implemented using a laser pointer system such as a system described in U.S. Pat. No. 5,138,304, or a pointing recognition system such as described in U.S. Pat. No. 6,720,949, the disclosures of which are incorporated herein by reference.

In FIG. 3, by way of example, interactive display system 122 comprises a pistol shaped laser pointer 124 to point to and select various regions of video screen 123. Each player 101 and 102 is shown holding a pistol shaped laser pointer 124 and video screen 123 displays a target 125. Player 101 uses the laser pistol to point to and select various regions of a target 125 displayed on his or her video screen 123 to generate and characterize a challenge displacement on gaming BAMPER 170 of player 102. Optionally, player 101 determines direction of a challenge displacement on the gaming BAMPER of player 102 by angular direction of a region player 101 selects relative to the center of target 125. Magnitude of the challenge displacement is optionally determined by how far the selected region is from the target center Similarly, player 102 uses laser pistol 124 to point to and select various regions of a target 126 displayed on his or her video screen 123 to generate and characterize a challenge displacement on gaming BAMPER 120 of player 101.

In the description and claims of the present application, each of the verbs, "comprise" "include" and "have", and conjugates thereof, are used to indicate that the object or objects of the verb are not necessarily a complete listing of components, elements or parts of the subject or subjects of the verb.

Descriptions of embodiments of the invention in the present application are provided by way of example and are not intended to limit the scope of the invention. The described embodiments comprise different features, not all of which are required in all embodiments of the invention. Some embodiments utilize only some of the features or possible combinations of the features. Variations of embodiments of the invention that are described, and embodiments of the invention comprising different combinations of features noted in the described embodiments, will occur to persons of the art. The scope of the invention is limited only by the claims.

The invention claimed is:

1. Apparatus for exercising a person's balance control, the apparatus comprising:

a motion stage operable to displace an object mounted thereto;

a treadmill mounted to the stage and comprising a belt having a runway surface on which a person using the treadmill stands, walks and/or runs;

at least one sensor that generates signals useable to determine a measure of proficiency of the person's balance control; and a controller that receives the signals and processes them to provide a measure of proficiency of the person's balance control and controls the motion stage to provide a displacement of the treadmill and thereby the treadmill runway surface responsive to the measure.

2. Apparatus according to claim 1 and comprising an actuator controllable by the controller to cause a displacement of the runway surface characterized a localized displacement of a region of the runway surface in a direction substantially perpendicular to the runway surface.

3. Apparatus according to claim 1 wherein the controller is programmable to control magnitude of a displacement of the runway surface.

4. Apparatus according to claim 1 wherein the controller is programmable to control direction of a displacement of the runway surface.

5. Apparatus according to claim 1 wherein the controller is programmable to control acceleration of the runway surface that provides a displacement of the runway surface.

6. Apparatus according to claim 1 wherein the controller is programmable to control deceleration of the runway surface that provides the runway surface displacement.

7. Apparatus according to claim 1 and comprising at least one device controllable by the controller to generate a warning to the person that the treadmill runway surface is about to be displaced.

8. Apparatus according to claim 7 wherein the controller controls duration of a time lapse between providing the alarm and the displacement of the treadmill

9. Apparatus according to claim 1 and comprising a harness for securing a person on the treadmill to prevent injurious falls.

10. Apparatus according to claim 1, and comprising apparatus configured to provide the person with a synthetic, virtual and/or augmented, reality.

11. Apparatus according to claim 10, wherein the apparatus configured to provide a synthetic reality generates virtual obstacles in the synthetic reality that challenge the person's posture.

12. Apparatus according to claim 10, wherein the apparatus configured to provide a synthetic reality generates sounds to disturb the person's balance control.

13. Apparatus according to claim 1 wherein the at least one sensor comprises an accelerometer.

14. Apparatus according to claim 1 wherein the at least one sensor comprises a strain gauge.

15. Apparatus according to claim 1 wherein the at least one sensor comprises a motion capture system that provides images for tracking the person's motions while on the treadmill.

16. Apparatus according to claim 1 wherein the measure of proficiency comprises a scalar function.

17. Apparatus according to claim 1 wherein the measure of proficiency comprises a tensor function.

18. Apparatus according to claim 17 wherein the tensor function comprises a one dimensional tensor.

19. Apparatus according to claim 17 wherein the tensor function comprises a two dimensional tensor.

* * * * *